US007244133B2

(12) United States Patent
Müller et al.

(10) Patent No.: US 7,244,133 B2
(45) Date of Patent: Jul. 17, 2007

(54) ELECTRICAL PLUG-AND-SOCKET CONNECTOR

(75) Inventors: Wolfgang Müller, Lüdenscheid (DE); Lars Baier, Berkheim (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 11/511,169

(22) Filed: Aug. 28, 2006

(65) Prior Publication Data

US 2007/0049111 A1 Mar. 1, 2007

(30) Foreign Application Priority Data

Aug. 30, 2005 (DE) ..... 10 2005 040 970

(51) Int. Cl.
*H01R 13/52* (2006.01)

(52) U.S. Cl. ..... 439/272; 439/587

(58) Field of Classification Search ..... 439/587–589, 439/271–282

See application file for complete search history.

(56) References Cited

U.S. PATENT DOCUMENTS 4,946,402 A 8/1990 Fink et al.
4,950,175 A 8/1990 Plyler et al.
5,197,898 A 3/1993 Nagamine
5,252,092 A 10/1993 Reider et al.
6,095,860 A 8/2000 Gehrke et al.

FOREIGN PATENT DOCUMENTS

EP 0 694 995 A1 1/1996

*Primary Examiner*—Truc Nguyen
(74) *Attorney, Agent, or Firm*—Brooks Kushman P.C.

(57) ABSTRACT

A connector includes two housings, a chamber block, and a seal. Passages arranged in a configuration extend through first housing top wall into first housing. Chamber block has chambers arranged in the configuration. Seal has openings arranged in the configuration and attaches to chamber block such that openings align with chambers. First housing houses chamber block and seal such that first housing top wall and chamber block sandwich seal and passages, openings, and chambers align. Second housing has plugs arranged in the configuration. Housings attach together such that first housing side wall and seal sandwich second housing side wall whereby seal seals housings and such that plugs extend into respective sockets in chambers. Electrical leads extend through the aligned passages, openings, and chambers and contact sockets to electrical connect with plugs. The seal simultaneously seals first housing in a region in which leads enter first housing and seals between housings.

16 Claims, 2 Drawing Sheets

ELECTRICAL PLUG-AND-SOCKET CONNECTOR

CROSS-REFERENCE TO RELATED APPLICATIONS

This application claims foreign priority benefits under 35 U.S.C. § 119(a)-(d) to DE 10 2005 040 970.9, filed Aug. 30, 2005, which is hereby incorporated by reference in its entirety.

BACKGROUND OF THE INVENTION

1. Field of the Invention

The present invention relates to an electrical plug-and-socket connector including a chamber block having chambers with plug-in sockets therein, a first plug-and-socket connector housing which houses the chamber block, a second plug-and-socket connector housing attached to the first connector housing and having plug pins, a seal sealing the connector housings from one another, and electrical leads extending through passages in the first connector housing into the chambers.

2. Background Art

DE 698 05 084 T2 (corresponding to U.S. Pat. No. 6,095,860) and DE 695 16 947 T2 disclose electrical plug-and-socket connectors having first and second plug-and-socket connector parts. The first connector part includes a first plug-and-socket connector housing and the second connector part includes a second plug-and-socket connector housing. The connector housings are attached to one another with a rubber seal inserted therebetween. Plug pins in one of the connector housings extend through openings in the seal and contact plug-in sockets in the other connector housing. The seal seals off the connector housings from one another to prevent moisture from penetrating into the transition region of the connector housings.

To completely seal an electrical plug-and-socket connector from moisture, the electrical feed line regions of the connector parts must also be protected from moisture penetration. This is not a problem when pin-shaped feed lines are injection molded into one of the connector housings. A connector part having such a design usually forms a fixedly installed part of an electrical plug-and-socket connector.

An electrical plug-and-socket connector typically has flexible electrical lead wires as the feed lines. Such lead wires or "leads" extend through the passages of one of the connector housings and are electrically and mechanically connected to the plug-in sockets or plug pins within the connector housings. Such plug-in sockets and plug pins are frequently used in retaining chambers of a chamber block for a mechanically stable arrangement.

In order to pass the leads through the one of the connector housings in a moisture-tight manner, the passages may be sealed either by subsequently casting around the leads or by providing an extra seal through which the leads are guided. Both of the subsequent casting and the extra seal as an additional component are costly.

SUMMARY OF THE INVENTION

An object of the present invention is to provide an electrical plug-and-socket connector which avoids the above-noted costs.

In carrying out the above object and other objects, the present invention provides an electrical plug-and-socket connector. The electrical plug-and-socket connector includes first and second plug-and-socket connector parts. The first connector part includes a first connector housing, a seal, and a chamber block. The first connector housing has a top end wall and a side wall which form an interior of the first connector housing. The first connector housing further has a plurality of passages arranged in a given configuration and extending through the top end wall into the first housing interior. The chamber block has a plurality of chambers arranged in the given configuration and extending through the chamber block. Each chamber is for retaining a plug-in socket therein. The seal has a plurality of openings arranged in the given configuration and extending through the seal. The seal is attached to the chamber block such that the openings respectively align with the chambers of the chamber block. The chamber block with the seal attached thereto are housed within the first connector housing interior such that the top end wall of the first connector housing and the chamber block sandwich the seal and such that the passages, the openings, and the chambers respectively align with one another.

The second connector part includes a second connector housing. The second connector housing has a bottom end wall and a side wall which form an interior of the second connector housing. The second connector housing further has a plurality of plug pins arranged in the given configuration and extending through the bottom end wall into the second housing interior. The second connector housing is attached to the first connector housing such that the first connector housing side wall and the seal sandwich the second connector housing side wall whereby the seal seals off the first and second connector housings from one another and such that the plug pins extend into respective ones of the plug-in sockets retained in the chambers of the chamber block. A plurality of electrical leads extend through respective ones of the aligned passages, openings, and chambers and contact respective ones of the plug-in sockets to be in electrical connection with respective ones of the plug pins.

In an embodiment, the seal (for example, a rubber seal) has a larger circumference than the circumference of the chamber block such that the edge of the seal radially extends past the edge of the chamber block. The seal edge engages the inner surface of the second connector housing side wall when the second connector housing is attached to the first connector housing. The seal edge includes a plurality of seal lips which engage the inner surface of the second connector housing side wall when the second connector housing is attached to the first connector housing.

In an embodiment, the side wall of the first connector housing includes a catch lever and the side wall of the second connector housing includes a catch. The catch and the catch lever engage with one another upon the second connector housing being attached to the first connector housing to lock the connector housings together.

In an embodiment, the seal includes a pair of retention openings and the chamber block includes a pair of retention bars. The retention bars engage the retention openings to attach the seal and the chamber block together. Each end of the retention bars includes a locking element. The locking elements engage the top wall of the first connector housing to attach the chamber block and the seal attached thereto to the first connector housing when the chamber block and the seal are housed within the first connector housing interior.

In general, the present invention achieves the object of providing an electrical plug-and-socket connector which avoids the above-noted costs by providing a seal between the chamber block and the first connector housing and passing the electrical leads through the openings of the seal.

Thus, according to the present invention, a common seal is provided which creates a sealing effect for the electrical leads in the region of the passages of the first connector housing while creating a moisture-tight sealing effect with respect to the second connector housing. That is, the single seal simultaneously fulfills two sealing functions: sealing of the first connector housing in a region in which the electrical leads enter the first connector housing; and sealing against a second connector housing connected to the first connector housing.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
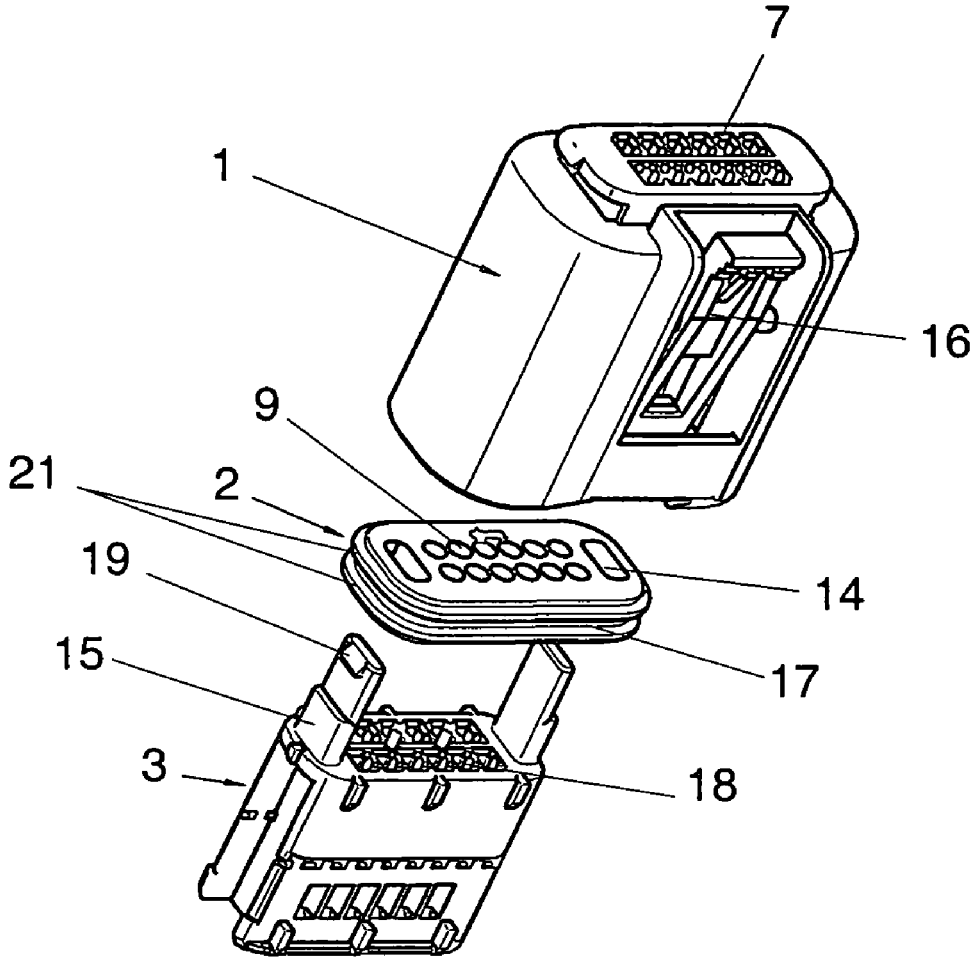
FIG. 1 illustrates an exploded view of a first plug-and-socket connector part of an electrical plug-and-socket connector in accordance with an embodiment of the present invention.

Referring now to FIG. 1, an exploded view of a first plug-and-socket connector part of an electrical plug-and-socket connector in accordance with an embodiment of the present invention is shown. In accordance with an embodiment of the present invention, the first connector part and a second plug-and-socket connector part (shown in FIG. 2) attach with one another to form the electrical plug-and-socket connector (shown in FIG. 3).

The first connector part includes a first plug-and-socket connector housing 1, a seal 2, and a chamber block 3. First housing 1 resembles the form of a cap having an elliptical or rectangular cross-section. First housing 1 includes a top end wall and a circumferentially extending side wall 10 (also shown in FIG. 3). The top end wall and side wall 10 of first housing 1 form an interior of the first housing with the underside of the first housing being open. First housing 1 includes integrally molded passages 7 longitudinally extending through the top end wall and leading to the interior of first housing 1. Passages 7 are integrally molded to the top end wall of first housing 1. Passages 7 are arranged in a given configuration of two rows.

Seal 2 is preferably made of rubber. Seal 2 is generally flat and has a circumferentially extending shape outlined by an edge 17. The circumferentially extending shape of seal 2 corresponds to the shape of circumferentially extending side wall 10 of first housing 1 but has a slightly smaller periphery than the periphery of the first housing side wall. Seal 2 includes a pair of retention openings 14 on opposite ends of the seal. Retention openings 14 longitudinally extend through seal 2. Seal 2 includes seal openings 9 which also longitudinally extend through the seal. Openings 9 are arranged in the given configuration of two rows. As will be described herein, first housing 1 houses seal 2 within the interior of the first housing and openings 9 are aligned with respective ones of passages 7 when the seal is housed within the first housing.

Chamber block 3 includes a body portion and top and bottom body sides. The body portion of chamber block 3 has a circumferentially extending shape corresponding to the circumferentially extending shape of seal 2 and the shape of the circumferentially extending side wall of first housing 1. The circumferentially extending shape of the chamber block body portion has a slightly smaller periphery than the periphery of seal 2. Chamber block 3 includes retaining chambers 18 longitudinally extending through the chamber block body and meeting the top and bottom chamber block body sides. Chambers 18 accommodate (i.e., receive therein) plug-in sockets 5 and plug pins 6 (shown in FIG. 3). Chambers 18 are arranged in the given configuration of two rows.

Chamber block 3 includes a pair of retention bars 15 on the opposite narrow ends of the chamber block body. Retention bars 15 are integrally molded as one-piece to the respective chamber block body end sides and project away from the top chamber block body side. Retention bars 15 pass through respective seal retention openings 14 to thereby attach seal 2 and chamber block 3 to one another. Seal retention openings 14 form a tight seal with retention bars 15 when the retention bars pass through the retention openings. Seal 2 meets with top chamber block body side upon the seal being attached to chamber block 3.

Figure 3:
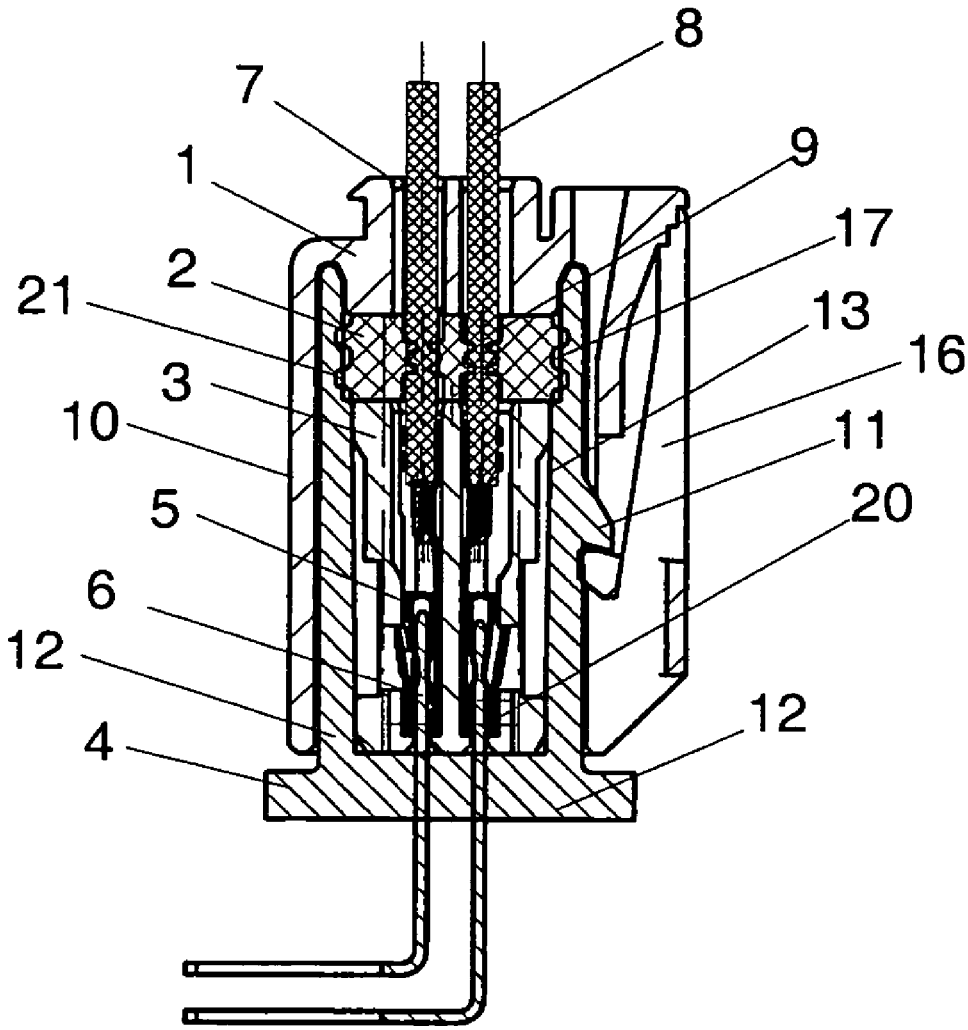
FIG. 3 illustrates a sectional view of the first and second plug-and-socket connector parts attached to one another to form the electrical plug-and-socket connector in accordance with an embodiment of the present invention.

Seal openings 9 are arranged in the given configuration of two rows. As such, openings 9 are respectively located in front of and aligned with chambers 18 when seal 2 is attached to chamber block 3 with the seal meeting the top chamber block body side. As the circumferentially extending shape of the chamber block body portion has a slightly smaller periphery than the periphery of the circumferentially extending shape of seal 2, seal edge 17 projects laterally beyond the edge of chamber block 3 when the seal and the chamber block are attached to one another (also see FIG. 3). Seal edge 17 faces the inner surface of side wall 10 of first housing 1 but is spaced apart from the first housing side wall as shown in FIG. 3.

The end of each retention bar 15 of chamber block 3 includes a locking element 19. Locking elements 19 engage respective portions of the interior surface of the top end wall of first housing 1 to attach chamber block 3 to the first housing upon the chamber block being inserted into the interior of the first housing. Locking elements 19 engage first housing 1 to make a locking connection of chamber block 3 to the first housing with the chamber block being housed within the interior of the first housing. As such, chamber block 3 with seal 2 attached thereon are both locked and housed within the interior of first housing 1 upon being inserted into the first housing. In this arrangement (shown in FIG. 3), seal 2 is sandwiched between the top side of chamber block 3 and the inner surface of the top end wall of first housing 1 with seal edge 17 laterally protruding beyond the chamber block and facing first housing side wall 10 spaced apart therefrom.

As described, first housing passages 7, seal openings 9, and chamber block chambers 18 are arranged in the given configuration of two rows. As such, the arrangements of passages 7, openings 9, and chambers 18 correspond to one another. Thus, passages 7, openings 9, and chambers 18 respectively align with one another when chamber block 3 with seal 2 attached thereto are inserted into and housed within first housing 1 and connected thereto.

Upon interconnecting first housing 1, seal 2, and chamber block 3 in the manner described with reference to FIG. 1 to form the first plug-and-socket connector part, the first plug-and-socket connector part may then be connected to a second plug-and-socket connector part (shown in FIG. 2) to form the complete electrical plug-and-socket connector (shown in FIG. 3).

Figure 2:
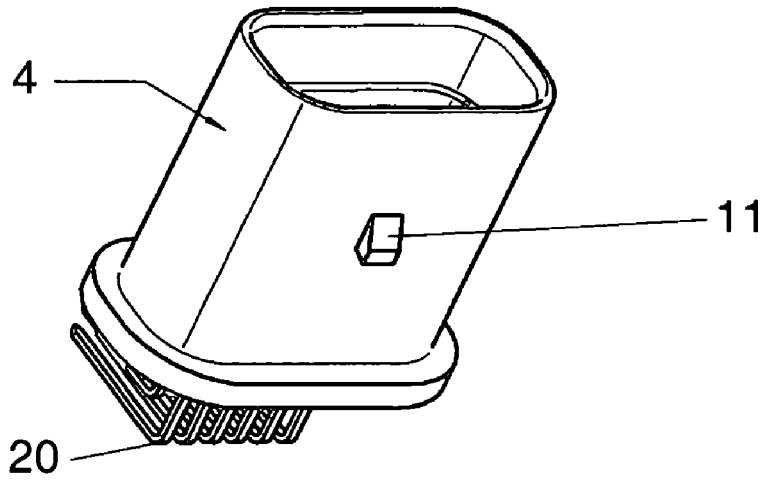
FIG. 2 illustrates a second plug-and-socket connector part of the electrical plug-and-socket connector in accordance with an embodiment of the present invention.

Referring now to FIG. 2, a second plug-and-socket connector part of the electrical plug-and-socket connector in accordance with an embodiment of the present invention is shown. The second connector part includes a second plug-and-socket connector housing 4. Like first housing 1, second housing 4 resembles the form of a cap having an elliptical or rectangular cross-section. Second housing 4 includes a bottom end wall and a circumferentially extending side wall 12. The bottom end wall and side wall 12 of second housing 4 form an interior of the second housing with the topside of the second housing being open. Second housing side wall 12 has a smaller circumference than the circumference of first housing side wall 10 such that second housing 4 can be received within the interior of first housing 1 and attached to the first housing.

A plurality of pin-shaped electrical feed lines 20 pass through the bottom end wall of second housing 4. Feed lines 20 are preferably injection molded to the bottom end wall of second housing 4. Feed lines 20 are in the given configuration of two rows. Each feed line 20 forms a respective plug pin 6 (shown in FIG. 3) within the interior of second housing 4. Plug pins 6 respectively insert into and are received by respective chambers 18 of chamber block 3 when second housing 4 and chamber block 3 with seal 2 mounted thereon are received by first housing 1.

A catch 11 is integrally molded onto the exterior surface of second housing side wall 12. Catch 11 and a catch lever 16 mounted onto first housing side wall 10 engage and lock with one another upon second housing 4 being received by first housing 1. The engagement between catch 11 and catch lever 16 enables second housing 4 to be attached to first housing 1 to thereby attach the first and second connector parts together and form the electrical plug-and-socket connector (shown in FIG. 3). The locking engagement between catch 11 and catch lever 16 protects the first and second connector parts against unintentional separation when attached together to form the electrical plug-and-socket connector.

Referring now to FIG. 3, a sectional view of the first and second plug-and-socket connector parts attached together to form the electrical plug-and-socket connector in accordance with an embodiment of the present invention is shown. As shown in FIG. 3, in order to form the electrical plug-and-socket connector, second housing 4 is inserted into the interior of first housing 1 such that second housing side wall 12 meets with and is encompassed by first housing side wall 10, the end of second housing side wall 12 meets the inner surface of the top end wall of the first housing, and the end of first housing side wall 10 meets the inner surface of the bottom end wall of the second housing. Thus, first housing side wall 10 overlaps second housing side wall 12 and the end portion of second housing side wall 12 is sandwiched between first housing side wall 10 and seal edge 17. Seal edge 17 firmly presses against inner wall 13 of the end portion of second housing side wall 12. The periphery of chamber block 3 faces inner wall 13 of second housing side wall 12. Plug pins 6 formed by feed lines 20 passing through the bottom end wall of second housing 4 are inserted into respective plug-in sockets 5 retained in chambers 18 of chamber block 3 to form a mechanical and electrical contact therewith.

In addition to the first and second connector parts, the electrical plug-and-socket connector further includes a plurality of flexible electrical lead wires 8. Lead wires 8 pass through respective passages 7 of first housing 1 and through respective openings 9 of seal 2 and into respective chambers 18 of chamber block 3 to thereby electrically connect with respective plug-in sockets 5 and respective plug pins 6 inserted into the plug-in sockets.

As shown, seal 2 is sandwiched between the inner surface of top end wall of first housing 1 and chamber block 3; and inner wall 13 of the end portion of second housing side wall 12 is sandwiched between seal edge 17 and the inner surface of first housing side wall 10. Seal 2 includes a plurality of seal lips 21 along seal edge 17. Seal lips 21 contact and engage with inner wall 13 of the end portion of second housing side wall 12 thereby sealing the transition region between first and second housings 1 and 4. Attachment of second housing 4 to first housing 1 by longitudinally inserting the second housing into the interior of the first housing radially or laterally compresses seal 2 thereby also pressing the seal against the passed-through leads 8 in the region of seal openings 9.

Seal 2 being a single unit thus advantageously simultaneously fulfills two sealing functions. First, sealing of the first connector part in a region where flexible leads 8 enter into first housing 1 via passages 7. Second, sealing against second housing 4 when the second housing is attached to first housing 1.

| List of Reference Numbers | |
|---|---|
| 1 | First plug-and-socket connector housing |
| 2 | Seal |
| 3 | Chamber block |
| 4 | Second plug-and-socket connector housing |
| 5 | Plug-in sockets |
| 6 | Plug pins |
| 7 | Passages |
| 8 | Lead Wires |
| 9 | Seal openings |
| 10 | Wall (of the first plug-and-socket connector housing) |
| 11 | Catch |
| 12 | Wall (of the second plug-and-socket connector housing) |
| 13 | Inner wall (of the second plug-and-socket connector housing) |
| 14 | Retention bar openings |
| 15 | Retention bars |
| 16 | Catch lever |
| 17 | Seal edge |
| 18 | Retaining chambers |
| 19 | Locking element |
| 20 | Pin-shaped feed lines |
| 21 | Seal lips |

While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An electrical plug-and-socket connector comprising:

a first housing having a top wall and a side wall which form an interior of the first housing, the first housing having passages arranged in a given configuration and extending through the top wall into the first housing interior;

a chamber block having chambers arranged in the given configuration and extending through the chamber block, each chamber for retaining a plug-in socket therein;

a seal having openings arranged in the given configuration and extending through the seal, wherein the seal is attached to the chamber block such that the openings respectively align with the chambers of the chamber block, wherein the seal has a larger circumference than the circumference of the chamber block such that the edge of the seal radially extends past the edge of the chamber block;

wherein the chamber block with the seal attached thereto are housed within the first housing interior such that the top wall of the first connector and the chamber block sandwich the seal and such that the passages, the openings, and the chambers respectively align with one another; and a second housing having a bottom wall and a side wall which form an interior of the second housing, the second housing having electrical leads extending from the exterior of the second housing through the bottom wall into the second housing interior, the electrical leads being molded to the bottom wall and forming plug pins arranged in the given configuration within the second housing interior, the second housing being attached to the first housing such that the first housing side wall and the seal sandwich the second housing side wall with the seal edge engaging the inner surface of the second housing side wall whereby the seal seals off the first housing from the second housing and such that the plug pins extend into respective ones of the plug-in sockets retained in the chambers of the chamber block.

2. The connector of claim 1 wherein:

the seal edge includes a plurality of seal lips which engage the inner surface of the second housing side wall when the second housing is attached to the first housing.

3. The connector of claim 1 wherein:

the side wall of the first housing includes a catch lever and the side wall of the second housing includes a catch, wherein the catch and the catch lever engage with one another upon the second housing being attached to the first housing to lock the housings together.

4. The connector of claim 1 wherein:

the seal is a rubber seal.

5. The connector of claim 1 wherein:

the seal includes a pair of retention openings and the chamber block includes a pair of retention bars, wherein the retention bars engage the retention openings to attach the seal and the chamber block together.

6. The connector of claim 5 wherein:

each end of the retention bars includes a locking element, wherein the locking elements engage the top wall of the first housing to attach the chamber block and the seal attached thereto to the first housing when the chamber block and the seal are housed within the first housing interior.

7. An electrical plug-and-socket connector comprising:

a first housing having a top wall and a side wall which form an interior of the first housing, the first housing having passages arranged in a given configuration and extending through the top wall into the first housing interior;

a chamber block having chambers arranged in the given configuration and extending through the chamber block, each chamber for retaining a plug-in socket therein;

a seal having openings arranged in the given configuration and extending through the seal, wherein the seal is attached to the chamber block such that the openings respectively align with the chambers of the chamber block, wherein the seal has a larger circumference than the circumference of the chamber block such that the edge of the seal radially extends past the edge of the chamber block;

wherein the chamber block with the seal attached thereto are housed within the first housing interior such that the top wall of the first connector and the chamber block sandwich the seal and such that the passages, the openings, and the chambers respectively align with one another;

a second housing having a bottom wall and a side wall which form an interior of the second housing, the second housing having electrical leads extending from the exterior of the second housing through the bottom wall into the second housing interior, the electrical leads being molded to the bottom wall and forming plug pins arranged in the given configuration within the second housing interior, the second housing being attached to the first housing such that the first housing side wall and the seal sandwich the second housing side wall with the seal edge engaging the inner surface of the second housing side wall whereby the seal seals off the first housing from the second housing and such that the plug pins extend into respective ones of the plug-in sockets retained in the chambers of the chamber block; and a second set of electrical leads extending through respective ones of the aligned passages, openings, and chambers and contacting respective ones of the plug-in sockets to be in electrical connection with respective ones of the plug pins.

8. The connector of claim 7 wherein:

the seal edge includes a plurality of seal lips which engage the inner surface of the second housing side wall when the second housing is attached to the first housing.

9. The connector of claim 7 wherein:

the side wall of the first housing includes a catch lever and the side wall of the second housing includes a catch, wherein the catch and the catch lever engage with one another upon the second housing being attached to the first housing to lock the housings together.

10. The connector of claim 7 wherein:

the seal is a rubber seal.

11. The connector of claim 7 wherein:

the seal includes a pair of retention openings and the chamber block includes a pair of retention bars, wherein the retention bars engage the retention openings to attach the seal and the chamber block together.

12. The connector of claim 11 wherein:

each end of the retention bars includes a locking element, wherein the locking elements engage the top wall of the first housing to attach the chamber block and the seal attached thereto to the first housing when the chamber block and the seal are housed within the first housing interior.

13. An electrical plug-and-socket connector comprising:

a first housing having a top wall and a side wall which form an interior of the first housing, the first housing having passages arranged in a given configuration and extending through the top wall into the first housing interior;

a chamber block having chambers arranged in the given configuration and extending through the chamber block;

a seal having openings arranged in the given configuration and extending through the seal, wherein the seal is attached to the chamber block such that the openings respectively align with the chambers of the chamber block, wherein the seal has a larger circumference than the circumference of the chamber block such that the edge of the seal radially extends past the edge of the chamber block;

wherein the chamber block with the seal attached thereto are housed within the first housing interior such that the top wall of the first connector and the chamber block sandwich the seal and such that the passages, the openings, and the chambers respectively align with one another; and a second housing having a bottom wall and a side wall which form an interior of the second housing, the second housing having electrical leads extending from the exterior of the second housing through the bottom wall into the second housing interior, the electrical leads being molded to the bottom wall and forming plug pins arranged in the given configuration within the second housing interior, the second housing being attached to the first housing such that the first housing side wall and the seal sandwich the second housing side wall with the seal edge engaging the inner surface of the second housing side wall whereby the seal seals off the first housing from the second housing and such that the plug pins extend into respective ones of the chambers of the chamber block.

14. The connector of claim 13 wherein:

the side wall of the first housing includes a catch lever and the side wall of the second housing includes a catch, wherein the catch and the catch lever engage with one another upon the second housing being attached to the first housing to lock the housings together.

15. The connector of claim 13 wherein:

the seal includes a pair of retention openings and the chamber block includes a pair of retention bars, wherein the retention bars engage the retention openings to attach the seal and the chamber block together.

16. The connector of claim 15 wherein:

each end of the retention bars includes a locking element, wherein the locking elements engage the top wall of the first housing to attach the chamber block and the seal attached thereto to the first housing when the chamber block and the seal are housed within the first housing interior.

* * * * *